United States Patent [19]

Sakakibara et al.

[11] 4,268,542

[45] May 19, 1981

[54] PROCESS FOR FORMING MULTI-LAYER COATINGS

[75] Inventors: Takao Sakakibara, Kasugai; Haruhiko Okazaki, Iwakura, both of Japan

[73] Assignee: Dai Nippon Toryo Co., Ltd., Osaka, Japan

[21] Appl. No.: 6,803

[22] Filed: Jan. 25, 1979

Related U.S. Application Data

[63] Continuation-in-part of Ser. No. 752,086, Dec. 20, 1976, Pat. No. 4,137,349.

[30] Foreign Application Priority Data

Dec. 26, 1975 [JP] Japan ..... 50-155964

[51] Int. Cl.[2] ..... B05D 3/02; B05D 3/08; B05D 3/10

[52] U.S. Cl. ..... 427/195; 427/203; 427/383.7; 427/386; 427/388.4; 427/409; 427/410

[58] Field of Search ..... 427/407 R, 409, 410, 427/383 R, 383 C, 385, 386, 388 A, 388 C, 388 R, 379, 380, 203, 202, 27, 195, 383.1, 383.7, 388.2, 388.1, 388.4, 407.1; 428/467

[56] References Cited

U.S. PATENT DOCUMENTS

| | | | |
|---|---|---|---|
| 2,198,939 | 4/1940 | Hempel | 427/409 |
| 2,878,141 | 3/1959 | Cannift | 427/409 |
| 3,089,783 | 5/1963 | Carlson et al. | 427/421 |
| 3,134,688 | 5/1964 | Hempel | 427/385 R |
| 3,156,580 | 11/1964 | Howard | 427/407 R |
| 3,408,278 | 10/1968 | Strodley | 204/181 T |
| 3,446,652 | 5/1969 | Smith | 427/374 R |
| 3,502,492 | 3/1970 | Spiller | 427/27 |
| 3,513,012 | 5/1970 | Point et al. | 427/27 |
| 3,663,383 | 5/1972 | Matsuda et al. | 204/181 T |
| 3,702,288 | 11/1972 | Erinjeri | 204/181 T |
| 3,713,872 | 1/1973 | Porter et al. | 427/407 R |
| 3,787,230 | 1/1974 | Hoffman et al. | 427/336 |
| 3,864,153 | 2/1975 | Enomoto | 427/409 |
| 3,870,546 | 3/1975 | Gelsomino | 427/407 R |
| 3,904,795 | 9/1975 | Mercurio | 427/409 |
| 3,953,643 | 4/1976 | Cheung et al. | 427/388 C |
| 3,953,644 | 4/1976 | Camelon | 427/410 |
| 3,998,716 | 12/1976 | Masar et al. | 204/181 T |
| 4,007,102 | 2/1977 | Springer et al. | 204/181 T |
| 4,104,416 | 8/1978 | Parthasarathy et al. | 427/202 |

FOREIGN PATENT DOCUMENTS

| | | | |
|---|---|---|---|
| 745349 | 2/1956 | United Kingdom | 427/407 R |

*Primary Examiner*—Michael R. Lusignan
*Assistant Examiner*—S. L. Childs
*Attorney, Agent, or Firm*—Bucknam and Archer

[57] ABSTRACT

The present invention relates to a process for forming a multi-layer coating including at least two coating layers by performing the oven drying step at one time, which comprises coating at least partially the surface of the substrate with a powder coating composition, then applying a slurry paint composition comprising synthetic resin particles dispersed in an aqueous medium and then heating.

4 Claims, 4 Drawing Figures

PROCESS FOR FORMING MULTI-LAYER COATINGS

This application is a Continuation-in-part of U.S. Ser. No. 752,086 filed Dec. 20, 1976 which issued on Jan. 30, 1979 as U.S. Pat. No. 4,137,349.

DESCRIPTION OF THE PRIOR ART

A multi-layer coating finish process for forming multi-layer coatings including at least two layers, for example, a base coat, an undercoat, an intercoat and a topcoat, is being applied in various fields, for example, in the automobile, light electrical appliance, plywood and other industries.

For example, when automobiles are coated, a primer is first applied in order to improve the adhesion between the resulting coating and the metal substrate, an intercoat (surfacer) is then formed on the primer layer in order to prevent convexities and concavities on the surface of the primer layer from being manifested on the surface of the final coating and to smoothen the coating surface, and finally, a topcoat paint is applied to the surface layer to form a coating excellent in such properties as surface smoothness and gloss.

In an industrial coating line employing a multilayer coating process, it is necessary to perform the sequence of coating operations for formation of multilayer coatings without a break and to complete these operations in a short time, and there have heretofore been adopted a multi-layer coating process in which at each coating step the formed coating layer is completely dried and the next coating paint is applied on the resulting dry film, and a multi-layer coating process called "two-coat-one-bake process" in which a paint is is applied on a precedingly applied coating layer while it is in the undried state and the entire coating is dried by one baking operation.

In the former process, however, since drying must be conducted at each coating step, the following disadvantages are brought about:

(1) The number of steps increases and a long time is required for completion of formation of the intended multi-layer coating.

(2) The number of drying ovens which must be disposed on a single coating line increases and therefore, a large space is occupied by these drying ovens and a large quantity of heat energy becomes necessary.

(3) Since a paint is applied to the surface of a dried coating film, the intercoat adhesion between adjacent coating layers is poor and it is often necessary to sand the dried coating film surface so as to improve this intercoat adhesion.

Since solvent type paints are used, the latter process involves the following defects:

(1) The working atmosphere is contaminated and there are risks of fire and explosion. Such contamination and risks are increased especially by a paint for forming a lower coating layer because it contains a low-boiling-point solvent in order to quicken drying.

(2) Solvent type paints run against recent trends favoring paints which are anti-polluting and conserve resources. Accordingly, it is necessary to provide an exhaust gas treatment apparatus or solvent recovery apparatus in the coating line, resulting in increase of the coating cost.

(3) In a paint for forming an upper layer, applicable solvents are limited because it is necessary to use a solvent which does not dissolve or swell the lower coating layer. As a result, applicable resins are also limited to those soluble in such specific solvent. Therefore, it is impossible to obtain a coating excellent in such properties as solvent resistance, water resistance, adhesion and corrosion resistance. Further, when a heretofore customarily used solvent type paint or water-soluble or emulsion paint is applied to an undried coating and the coating layers are baked at one time, there are brought about the following disadvantages:

(1) Since the coating of the surface layer is dried and formed into a compact film at the baking step, the solvent or water left in the lower coating layer is inhibited from evaporation and such undesirable phenomena as blistering, cracking and formation of pin holes are caused.

(2) Since a solvent type paint or water-soluble paint contains a considerable amount of an organic solvent, if it is applied to an undried coating in the non-fluid state, sagging, swelling and lifting are readily caused. This tendency is especially conspicuous when a lower layer coating is formed from a paint comprising a resin having a low cross-linking density, for example, an electrodeposition paint or a water-soluble paint, or from a paint having a high pigment content, for example, a corrosion-resistant paint.

Because of these disadvantages, a homogeneous coating is not formed and it is impossible to provide a practical coating excellent in effects of decorating and protecting a coated article.

If a powder paint is used for formation of a surface layer, the foregoing problems are solved, because such a paint does not contain an organic solvent and a solvent in the lower coating layer can evaporate through clearances among particles of the powder paint. However, since a special coating apparatus must be used for application of a powder paint, a coating line for ordinary paints cannot be used and the coating cost becomes high.

In addition to the foregoing paints, a so-called slurry paint comprising resin particles dispersed in water is known in the art. For example, there are known a paint formed by dispersing in water chlorinated polyether resin particles having a size smaller than 200 mesh (see the specification of U.S. Pat. No. 3,089,783) and a paint formed by dispersing chlorinated polyether resin particles in water containing a surfactant, an ester of a polyhydric alcohol with a lower aliphatic monocarboxylic acid, an alkaline water softener and a lower aliphatic alcohol (see the specification of U.S. Pat. No. 3,446,652).

As the method for applying such slurry paints, there are known a method comprising spray-coating a paint on an article to be coated, evaporating water from the coating and curing the coating to form a coating film (see the specification of U.S. Pat. No. 3,787,230) and a process comprising spray-coating on aqueous dispersion of nylon resin particles on an article to be coated which is maintained at a temperature higher than 100° C. (see the specification of U.S. Pat. No. 2,972,553).

These coating methods are not directed to formation of multi-layer coatings and according to these methods, it is difficult to shorten the time for the coating operation.

A process comprising spray-coating or roll-coating a topcoat paint on a coating of an undercoat paint in the fluid state has been used in the art for forming a special pattern of convexities and concavities or a special multicolor pattern.

According to this process, however, the smoothness and gloss of the resulting coating are degraded and therefore, it is impossible to obtain a multilayer coating excellent in surface characteristics.

As will be apparent from the foregoing illustration, in the art there has not been known a multilayer coating process capable of reducing the number of steps in the coating process, shortening the time for the coating operation and meeting general requirements of prevention of pollution and conservation of resources.

SUMMARY OF THE INVENTION

The present invention relates to a process for forming a multi-layer coating including at least two coating layers by performing the oven drying step at one time, which comprises coating at least partially the surface of the substrate with a powder coating composition, then applying a slurry paint composition comprising synthetic resin particles dispersed in an aqueous medium and then heating.

DETAILED DESCRIPTION OF THE INVENTION

It is a primary object of the present invention to provide a multi-layer coating process in which heat energy required for the coating operation is remarkably reduced.

Another object of the present invention is to provide a multi-layer coating process in which the time for the coating operation is remarkably shortened.

Still another object of the present invention is to provide a multi-layer coating process which discharges no pollutants such as exhaust gases and waste water, involves no risk of fire or explosion, enables recovery of lost paints, such as overspray mist in spray-coating or drips and tears in dip coating, and fully meets general requirements for prevention of pollution and conservation of resources.

The slurry paint that is used in the present invention is an aqueous dispersion type composition formed by dispersing synthetic resin particles having an average particle size of 0.5 to 80μ in an aqueous medium so that the solid content is 10 to 60% by weight, preferably 20 to 60% by weight.

The slurry paint has various merits, such as mentioned below.

(a) In the slurry paint water constitutes the only or the major part of the volatile components. Accordingly, when the slurry paint is used as a topcoat, it does not cause any of dissolution, swelling or lifting of the undercoat layer.

(b) Organic solvents, volatile basic substances or surface active agents are not contained in the slurry paint in large quantities. Accordingly, the slurry paint fully meets requirements of prevention of pollution and conservation of resources. Further, it provides coatings excellent in water resistance, chemical resistance and other properties.

(c) Since the solid content is as high as about 40 to about 60% by weight, a thick coating can be formed by one coating operation.

(d) A conventional coating apparatus for solvent type paints can be used for the slurry paint without any particular modification. Accordingly, customary coating procedures and equipment can be adopted and the coating operation can be performed at a low cost.

The slurry paint, however, has some defects that resin particles dispersed in an aqueous dispersion medium are readily precipitated and agglomerated during storage and cracking is readily caused in the resulting coating at the oven drying step.

In the slurry paint that is used in the present invention, in order to moderate or completely eliminate these defects, it is preferred that an ordinary water-soluble resin and/or an ordinary emulsion type resin be incorporated in amounts (as solids) of up to 30 parts by weight, especially up to 10 parts by weight, particularly especially up to 5 parts by weight, per 100 parts by weight of resin particles.

The slurry paint that is used in the present invention may further comprise appropriate amounts of additives such as a flow modifier, a surface active agent, a coated surface wetting agent, a thickener, a delustering agent and a rust inhibitor.

According to need, inorganic and organic coloring and extender pigments may be incorporated in the slurry paint that is used in the present invention. These pigments are dispersed in either or both of the resin particles and the aqueous medium and kneaded therewith. A metallic or high brilliance coating can be prepared from a slurry paint comprising a dispersed flaky aluminum pigment of finely crystalline flaky pigment in an amount of 0.05 to 30 parts by weight per 100 parts by weight of the resin particles.

In view of the smoothness of the resulting coating, the adaptability to the coating operation and the storage stability, the particle size of synthetic resin particles to be used for formation of a slurry paint in the present invention must be adjusted beloqw 80μ. Further, in order to prevent surface drying of the coating and occurrence of sagging in the coating, the particle size must be larger than 0.5μ. Use of synthetic resin particles having a size of 4 to 30μ is especially preferred.

In order to prevent agglomeration and cohesion of resin particles, it is required for the resin particles to have a softening point higher than 5° C. Further, in order for the resin particles to melt and form a film at a heating temperature at 80° to 240° C., they must have a softening point not exceeding 120° C.

Resin particles having a softening point higher than 50° C. are especially preferred because at the oven drying step they retain a sufficient gas permeability prior to melting to form a smooth film.

As the resin constituting resin particles that are used in the present invention, there can be mentioned, for example, epoxy resins, amine-modified resins, phenolic resions, urea resins, saturated polyester resins, polyether resins, unsaturated polyester resins, blocked isocyanate resins, melamine resins, acrylic resins, alkyl resins, and derivatives and mixtures thereof. As the above-mentioned water-soluble and emulsion resin that may be incorporated into the slurry paint, there can be mentioned, for example, alkyd resins, vinyl acetate resins, ethylene-vinyl acetate copolymers, vinyl acetate-acrylic monomer copolymers, melamine resins, acrylic resins, polyester resins, polyether resins, urea resins, styrene-butadiene copolymers, polyvinyl butyral resins, epoxy resins, polybutadiene resins, phenolic resins, and derivatives and mixtures thereof.

The term "resin composition" in the present invention means (1) essential particle-constituting resins or (2) a composition comprising the essential particle-constituting resins and water-soluble resin or an emulsion resin.

Said resin compositions are thermosetting. When at least two functional groups capable of reacting with each other are contained in the resinous composition, for example, in the case of such combination as phenolic resin-epoxy resin, epoxy resin-melamine resin, acrylic resin-blocked isocyanate resin, acrylic resin-melamine resin, polyester resin-melamine resin, polyester resin-blocked isocyanate resin, alkyd resin-amino resin, alkyd resin-phenolic resin, epoxy resin-amine modified resin, epoxy resin-curing agent and acrylic resin-curing agent, the resinous composition has thermosetting characteristics.

In case at least two functional groups capable of reacting with each other are contained in the resinous composition, the thermosetting reaction may occur in two or more kinds of resin particles, in two or more kinds of water-dilutable resins or between the resin particles and the water-dilutable resin, or in two or more of these in combination. Resin particles or water-dilutable resin having no functional group capable of causing the curing reaction may be incorporated in such combination of the resin.

The mixing ratio of the resins participitating in the curing reaction may be adjusted appropriately.

According to one embodiment, 10–70 parts by weight of a water-soluble aminoplast resin are combined with 100 parts by weight of at least one member selected from acrylic resins and alkyd resins having an acid value of 30 to 80.

In the case of thermosetting resinous composition comprising a water-dilutable resin and resin particles capable of reacting with each other, it is preferred that a water-soluble aminoplast resin be used as the water-dilutable resin, particles of an acrylic resin having a hydroxyl value of 0.05 to 100, an acid value of 5 to 30 and a number average molecular weight of about 3000 to about 35000 be used as the resin particles and the aminoplast resin be incorporated in an amount of 0.5 to 100% by weight, especially 1 to 30% by weight, based on the resin particles. In this case, it is especially preferred that the resin particles comprise at least 30% by weight of the acrylic resin.

At least two kinds of resins capable of reacting with each other or a thermosetting resin and a curing agent may be present in the respective particles. Alternately, they may be formed into two different kinds of particles and they may be used in the form of a mixture. In this case, the water-dilutable resins are thermosetting.

Preferred resin combinations capable of causing the curing reaction are as follows:

(i) A composition comprising an acrylic resin having a hydroxyl value of 20 to 120 and a number average molecular weight of 3000 to 35000 and a blocked isocyanate resin at a weight ratio of from 100/5 to 100/100, preferably from 100/10 to 100/50, especially preferably a composition in which the blocked isocyanate resin has an isocyanate equivalent of 100 to 2000 and the mixing ratio of the acrylic resin and the blocked isocyanate resin is such that the ratio of the number of isocyanate groups to the number of hydoxyl groups is from 0.4 to 1.2.

(ii) A composition comprising an acrylic copolymer containing 0.5 to 30% by weight of glycidyl group-containing $\alpha,\beta$-ethylenically unsaturated monomer segments in the molecule and at least one member selected from dibasic acids, polybasic acids and acid anhydrides at a weight ratio of from 100/3 to 100/30, preferably from 100/5 to 100/20.

(iii) A composition comprising an acrylic copolymer containing 0.5 to 30% by weight of blocked isocyanate group-containing $\alpha,\beta$-ethylenically unsaturated monomer segments in the molecule and a polyhydric alcoholic hydroxyl group-containing compound at a weight ratio of from 100/5 to 100/100, especially preferably a composition in which the isocyanate equivalent of the blocked isocyanate group-containing copolymer is 100 to 2000 and the copolymer is mixed with the polyhydric alcoholic hydroxyl compound at such a ratio that the ratio of the number of isocyanate groups to the number of hydroxyl groups is from 0.4 to 1.2.

(iv) A composition comprising an epoxy resin having an epoxy equivalent of 400 to 5000 and a softening point of 40° to 120° C. and at least one member selected from amines, polybasic acids, aminoplast resins, imidazoles, acid anhydrides, blocked isocyanates, triazoles and dicyandiamine at a weight ratio of from 100/0.5 to 100/30.

(v) A composition comprising a polyester resin having a hydroxyl value of 30 to 100 and a softening point of 20° to 120° C. and at least one member selected from acid anhydrides and blocked isocyanates at a weight ratio of from 100/5 to 100/80, especially preferably a composition in which a blocked isocyanate resin having an isocyanate equivalent of 100 to 2000 is mixed with the polyester resin at such a mixing ratio that the ratio of the number of isocyanate groups to the number of hydroxyl groups is from 0.4 to 1.2.

(vi) A composition comprising an acrylic resin having a hydroxyl value of 0.05 to 100, an acid value of 50 to 30 and a number average molecular weight of 3000 to 35000 and an aminoplast resin, preferably a methylolated product of urea, benezoguanamine or melamine, a methyl-etherified or butyl-etherified product of such methylolated product or a mixture of two or more of these condensates, at an acrylic resin/aminoplast resin mixing weight ratio of from 100/10 to 100/100, preferably from 90/10 to 50/50.

In the instant specification and claims, the powder paint composition is applied first to form an "undried coating in the non-fluid state", that is a coating which may be formed by electrostatic coating but has not yet been heated.

In the present invention, it is possible to adopt an embodiment in which after the slurry paint has been applied to a lower coating layer and while it is in the non-fluid state, application of the slurry paint is repeated several times to increase the number of layers in the coating.

The so prepared coating including at least two layers is heated at a temperature higher than the film-forming temperature of the coating just after formation of the coating or preliminary drying of the upper layer by setting or pre-heating. By the term "the film-forming temperature of the coating" is meant a highest temperature among film-forming temperature of respective coating layers.

The effects and advantages attained by the present invention are as follows:

(1) Formation of a multi-layer coating including at least two coating layers can be performed by conducting oven drying at one time and a coating film is obtained only by one oven drying operation. Accordingly, the coating process can be simplified, the scale of the coating equipment can be reduced, energy necessary for baking can be remarkably reduced, and it is possible to lower the coating cost.

(2) In the conventional multi-layer coating process, in order to attain sufficient adhesion between the heated and hardened layer and the layer to be applied thereon, it is necessary to perform an intermediate treatment such as sanding the surface of the hardened coating. In the present invention, since respective layers are heated and hardened at one time, the sanding treatment becomes unnecessary and a sufficient intercoat adhesion strength can be obtained between every two adjacent layers.

The powder paint used in the present invention includes a known thermoplastic powder paint and a thermosetting powder paint.

As the thermoplastic powder paint, there can be mentioned those containing, as the coating-forming binder, vinyl chloride resins such as vinyl chloride homopolymers and copolymers of vinyl chloride with vinyl acetate, acrylonitrile, vinylidene chloride, acrylic acid esters or the like, polyoelfin resins such as polyethylene and polypropylene, polyamide resins such as nylon 11 and nylon 12, high-molecular-weight linear saturated polyesters, cellulose derivatives such as cellulose acetate butyrate, and chlorinated polyethers.

As the thermosetting powder paint, there can be mentioned those containing, as the coating-forming binder, epoxy resin compositions comprising a bisphenol-A type epoxy resin, a novolak type epoxy resin or an alicyclic epoxy resin and a cross-linking agent such as dicyandiamide or its derivative, an acid anhydride, an aromatic diamine, a $BF_3$-amine complex, imidazole or dihydrazide; thermosetting polyester resin compositions comprising a saturated polyester or unsaturated polyester obtained by condensing a polyhydric alcohol such as ethylene glycol, propylene glycol, trimethylol propane, pentaerythritol or bisphenol-A with a saturated polybasic acid such as phthalic acid, phthalic anhydride, isophthalic acid, terephthalic acid or adipic acid and/or an unsaturated polybasic acid such as maleic anhydride, maleic acid, fumaric acid or itaconic acid and a curing agent for the saturated polyester, such as an acid anhydride, a melamine resin, a blocked isocyanate compound or a compound having at least 2 glycidyl groups in the molecule, or a curing agent for the unsaturated polyester, such as an ethylenic crosslinking monomer; resin compositions comprising a hydroxyl group-containing acrylic resin and a curing agent such as a melamine resin, an acid anhydride, a blocked isocyanate, an alkoxymethyl isocyanate or a carboxyl group-containing acrylic resin; resin compositions comprising a carboxyl group-containing acrylic resin and a curing agent such as a diepoxy compound, a polyvalent oxazoline or a polyvalent oxazine; resin compositions comprising a glycidyl group-containing acrylic resin and a curing agent such as a polyvalent carboxylic acid, an acid anhydride, a polyhydric phenol or a polyvalent amine; and N-alkoxymethyloamido group-containing acrylic resins (self-crosslinking type) and compositions comprising such acrylic resin and a curing agent such as an epoxy resin or a polyhydroxyl compound.

These powder paints are coated on articles according to customary coating methods such as the spray coating method, the flame spray coating method, the plasma spray coating method, the fluidized dip coating method, the electrostatic fluidized dip coating method and the fuming cupboard coating method.

THe present invention will not be described in detail by reference to the following Examples, in which all of "parts" and "%" are by weight unless otherwise indicated.

EXAMPLE 1

(Preparation of powder paint)

A mixture of 83 parts of an epoxy resin having an epoxy equivalent value of 450 to 535 and a softening point of 64° to 76° C. (manufactured and sold under the tradename "Epikote #1001" by Shell Chemicals Co. Ltd.), 1 part of 2-phenylimidazole, 13 parts of tetrahydrophthalic anhydride, 20 parts of titanium dioxide and 2 parts of Phthalocyanine Blue was melted and kneaded homogeneously. The resulting mixture was mechanically pulverized to obtain resin particles having a size smaller than 120 mesh. The mixture was further pulverized mechanically and classified to obtain a powder paint capable of passing through an 18-mesh sieve.

(Preparation of Slurry Paint)

A mixture of 20 parts of ethyl acrylate, 10 parts of lauryl methacrylate, 55 parts of styrene and 15 parts of glycidyl acrylate was polymerized according to a customary method to obtain a copolymer having a softening point of about 40° C. and a number average molecular weight of about 5500. Then, 94 parts of this copolymer was heated, molten and kneaded with 6 parts of trimellitic acid, 18 parts of titanium dioxide and 2 parts of Phthalocyanine Blue. The resulting mixture was mechanically pulverized to obtain resin particles having a size smaller than 200 mesh. Then, 120 parts of the pulverized resin was added to a solution formed by dissolving 0.2 part of a non-ionic surface active agent homogeneously in 120 parts of water, and the mixture was sufficiently agitated in such a manner that bubbling did not take place. Then, the resin particles were further pulverized in a ball mill so that the particle size was smaller than 10$\mu$. Then, 0.8 part of a thickener and 45 parts of water were added to the above resin composition to obtain a paint composition (A).

Separately, in a nitrogen current, 40 parts of an epoxy resin (manufactured and sold under the tradename "Epikote #828" by Shell Chemicals Co., Ltd.) and 100 parts of linseed oil fatty acid were heated and agitated at 230° C. for 3 hours to obtain an epoxy ester resin having an acid value of 10. Then, 20 parts of maleic anhydride was added to this epoxy ester resin and the mixture was heated and agitated at 180° C. for 4 hours to obtain a maleinized epoxy ester resin having an acid value of 140. Then, 100 parts or isopropyl alcohol was added to the resin to dissolve it therein, 38 parts of diethanol amine was then added to effect partial neutralization, and 102 parts of water was added to obtain a water-dispersible resin composition having a pH of 7.8 and a resinous non-volatile component content of 40%.

To 100 parts of the above-mentioned paint composition (A) was added 4.2 parts of the above-mentioned water-dispersible resin composition to obtain a slurry paint.

The powder paint was applied to a soft steel plate in amount of 50 g/m$^2$ and the slurry paint was applied thereto according to the curtain flow coating method. The coating was allowed to stand still for 15 minutes to obtain a set-to-touch coating, and this coating was then pre-heated at 90° C. for 10 minutes and baked at 170° C. for 25 minutes to obtain a two-layer finish coating having a thickness of 70$\mu$.

TABLE 1

| Example No. | Coating[1] Operation Adaptability | Coated[2] Surface Condition | Properties of Coating Gloss[3] | Properties of Coating Adhesion[4] | Water[5] Resistance | Moisture[6] Resistance | Salt Spray[7] Resistance |
|---|---|---|---|---|---|---|---|
| 1 | good | not changed | 92 | 100/100 | not changed | not changed | not changed |

Notes
[1]Occurrence of sagging, cissing, swelling and lifting was examined with the naked eye.
[2]Occurrence of blistering, pinhole formation and cissing was examined with the naked eye.
[3]60°/60° specular gloss value.
[4]Cross-cut adhesion test (11 parallel cut at in intervals of 2 mm reacting the substrate were made on the coating in both the lateral and longitudinal directions to form 100 cut squares, an adhesive tape was applied thereto, the applied tape was violently peeled from one end, and the number of cut square left on the substrate was examined).
[5]The condition of the coating surface after dipping in water for 72 hours.
[6]The salt spray test was conducted for 120 hours according to the method of JIS K-5400, 7.8.

EXAMPLE 2

A liquid paint was prepared by homogeneously mixing and kneading 110 parts by weight of a 60% by weight acetone solution of an acrylic resin having a softening point of 45° C., a molecular weight of 17000 and a hydroxyl value of 60, 50 parts by weight of a 60% by weight acetone solution of a blocked isocyanate resin having a softening point of 68° C. and an isocyanate equivalent of 770, 0.5 part by weight of an organic tin compound (dissociation catalyst), 0.5 part by weight of a surface adjusting agent, 20 parts by weight of titanium white, 5 parts by weight of yellow iron oxide and 1.5 parts by weight of red iron oxide. The so prepared liquid paint was emulsified in 5000 parts by weight of water while being agitated at a high speed by a rotary blade type stirrer to transfer the acetone into water to form resin particles. The resin particles were separated from the water-acetone mixed liquid by filtration, washed with water and separated from water by filtration to recover water-containing resin particles having a solid content of 60% by weight. Then, 100 parts by weight of the so recovered water-containing resin particles were mixed with 0.2 part by weight of a non-ionic surface active agent, 0.5 part by weight of a polycarboxylic acid type thickener and 20 parts by weight of water, and the mixture was wet-pulverized in a ball mill to obtain a slurry paint in which the softening temperature of the resin particles was 50° C. and 70% of the resin particles had a size in the range of from 5 to 30μ.

A thermoplastic polyester resin powder paint (VPET #1360 Gray manufactured by Dai Nippon Toryo Co., Ltd. softening temperature=50° C.) was electrostatically coated on a zinc-coated steel plate panel for a curtain wall so that the thickness of the dry coating was 80μ. Then, the above slurry paint was applied to the coated surface by a spray gun and the coated panel was heated at 200° C. for 15 minutes. A coating excellent in smoothness and luster was formed on the panel.

EXAMPLE 3

A black thermosetting acrylic resin powder paint (VPET #1370QD Black manufactured by Dai Nippon Toryo Co., Ltd. softening temperature=40° C.) was air-sprayed and coated on a degreased aluminum foil so that the thickness of the dry coating was 50μ. Then, only the powder paint applied to a polished surface area was removed by air-blowing and the polished surface was exposed. Next, a clear slurry paint containing 42% by weight of a thermosetting acrylic resin powder having an average particle size of 8μ and a softening temperature of 35° C. (slurric #1100 Clear manufactured by Dai Nippon Toryo Co., Ltd.) was air-sprayed and coated on the entire surface of the aluminum foil so that the thickness of the dry coating was 70μ. Then, the coated aluminum foil was heated at 180° C. for 15 minutes to effect curing and form a coating film. The resulting aluminum foil had a clear coating on a black enamel coating in the cast skin area, and the convexities and concavities of the cast skin area were smoothly coated and the cast skin area had a lustrous appearance. Further, the polished surface area had a lustrous metallic appearance owing to the clear coating. The so formed prepared aluminum foil therefore had a very high commercial value.

EXAMPLE 4

A liquid paint was prepared by homogeneously mixing and kneading 56 parts by weight of a 60% by weight acetone solution of an acrylic resin having a hydroxyl value of 40, an acid value of 18, a softening temperature of 41° C. and a weight average molecular weight of 15000, 24 parts by weight of a 60% by weight acetone solution of a melamine resin (Rejimen RF-3403 manufactured by Monsanto Corp.), 5 parts by weight of a 20% by weight acetone solution of cellulose acetate butyrate (CAB-551-02 manufactured by Eastmen Kodak Co.), 8 parts by weight of a 20% by weight acetone solution of dimethyl phthalate, 0.5 part by weight of a silicone type surface adjusting agent, 20 parts by weight of titanium white, 0.5 part by weight of Phthalocyanine Blue and 0.5 part by weight of a quinacridone type red pigment. The so prepared liquid paint was emulsified into 5000 parts by weight of water while being agitated at a high speed by a rotary blade type stirrer to transfer the acetone into water to form resin particles. The resin particles were separated from the water-acetone mixed liquid by filtration, dried in a fluidized bed and classified to obtain a powder paint having a particle size of less than 40μ and a softening temperature of 41° C.

Separately, the above resin particles were washed with water and separated from water by filtration to obtain water-containing resin particles having a solid content of 65% by weight. Then, 100 parts by weight of the so obtained water-containing resin particles were added to 35 parts by weight of an aqueous solution containing 0.2 part by weight of a non-ionic surface active agent and 0.4 part by weight of a thickener (Organite A manufactured by Hojun Yoko Corp.), and the mixture was wet-pulverized in a ball mill to obtain a slurry paint in which 75% of the resin particles had a particle size in the range of from 4 to 30μ.

The above powder paint was electrostatically spray-coated on a net portion, a corner portion, an edge portion and a peripheral portion of the housing case of an air conditioner, and the above slurry paint was subsequently coated on the entire surface of the housing case by means of a disc type electrostatic coating apparatus. The coating was heated at 170° C. for 20 minutes to effect curing and form a coating film.

When a coating apparatus for coating the entire surface, such as the above-mentioned disc type electrostatic coating apparatus, is employed, the thickness of the coating is not increased in such areas as the above-mentioned net portion, corner portion and edge portion. In this Example, however, since the powder paint was preliminarily applied, a uniform coating finish could be obtained over the entire surface not only in the areas where both the powder paint and slurry paint were coated in the overlapped state but also in the areas where only the slurry paint was coated. Therefore, reduction of the anti-corrosive effect or degradation in appearance because of insufficient coating did not occur. Moreover, defects observed at the time of ordinary repair coating using one liquid paint, such as bubbling, formation of pinholes and flooding, could be eliminated.

EXAMPLE 5

A low temperature curing type epoxy resin powder paint using dicyandiamide and imidazole as the curing agent (VPET #1340 QD Black manufactured by Dai Nippon Toryo Co., Ltd.; softening temperature=55° C.) was electrostatically wated on a farming machine so that the thickness of the dry coating was 70μ.

A mixture comprising 65 parts by weight of an amine-curing type epoxy resin powder paint (VPET #1340 Black manufactured by Dai Nippon Toryo Co., Ltd.; softening temperature=55° C.), 0.2 part by weight of a non-ionic surface active agent, 0.4 part by weight of a thickener and 70 parts by weight of water, was wet-pulverized in a ball mill to obtain a slurry paint in which 80% of the resin particles had a particle size in the range of from 4 to 40μ.

The so prepared slurry paint was spray-coated on the powder paint-coated part of the farming machine so that the thickness of the dry coating was 30μ. The coating was heated at 200° C. for 20 minutes to effect curing and form a coating film. The resulting coating had a total thickness of 100μ and was excellent in smoothness.

EXAMPLE 6

A thermosetting polyester resin powder paint comprising a hydroxyl group-containing polyester resin and an acid anhydride curing agent (VPET #1360 Green manufactured by Dai Nippon Toryo Co., Ltd.; softening temperature=60° C.) was electrostatically coated on an outer casing of an electric refrigerator.

A mixture of 65 parts by weight of the above-mentioned powder resin (VPET #1360 Green), 0.2 part by weight of a non-ionic surface active agent, 0.4 part by weight of a thickener and 70 parts by weight of water was wet-pulverized in a ball mill to obtain a slurry paint in which 80% of the resin particles had a particle size in the range of from 5 to 45μ.

The so prepared slurry paint was spray-coated on the powder paint-coated outer casing of the refrigerator, especially areas where adhesion of the powder paint was insufficient and surrounding areas where the thickness was small, and the coating was heated at 200° C. for 20 minutes to effect curing and form a coating film.

The resulting coating was uniformly smooth and lustrous as in the preceding Examples.

The drawings illustrate the process of the present invention and specifically example 2–6.

Figure 1:
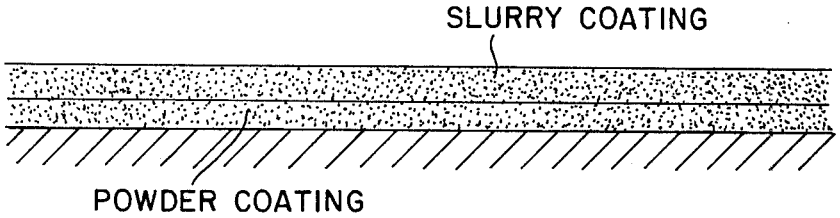
FIG. 1 illustrates the process of Examples 2 and 5 in which two even coatings of powder coating and slurry coating are applied to the substrate.
Figure 2:
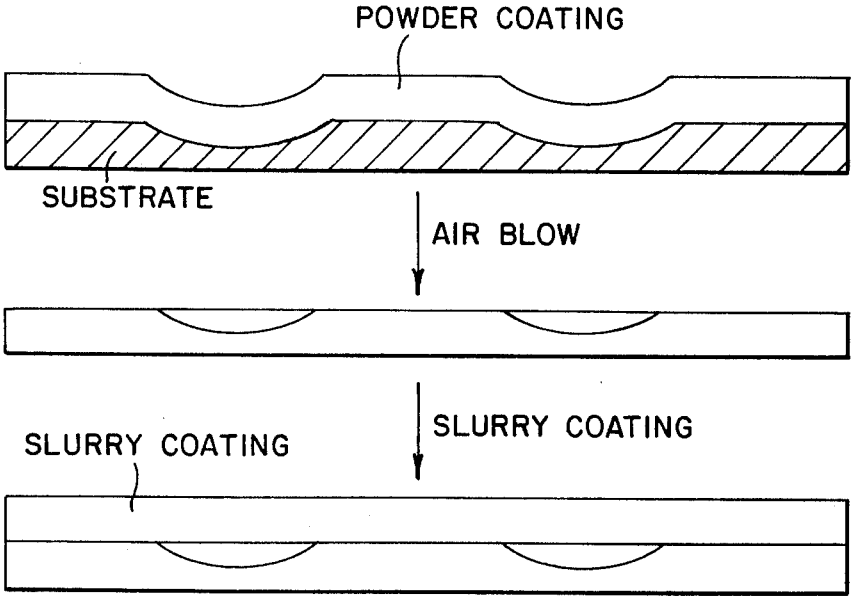
FIG. 2 illustrates the process of Example 3.
Figure 3:
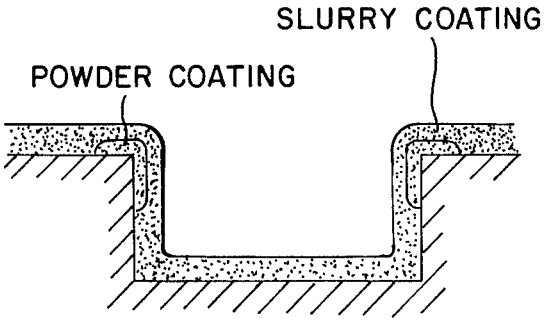
FIG. 3 illustrates the process of Example 4 in which the powder coating is applied only to the corners and the slurry paint is applied afterwards by means of a disc type electrostatic coating apparatus. An even coating is obtained.
Figure 4:
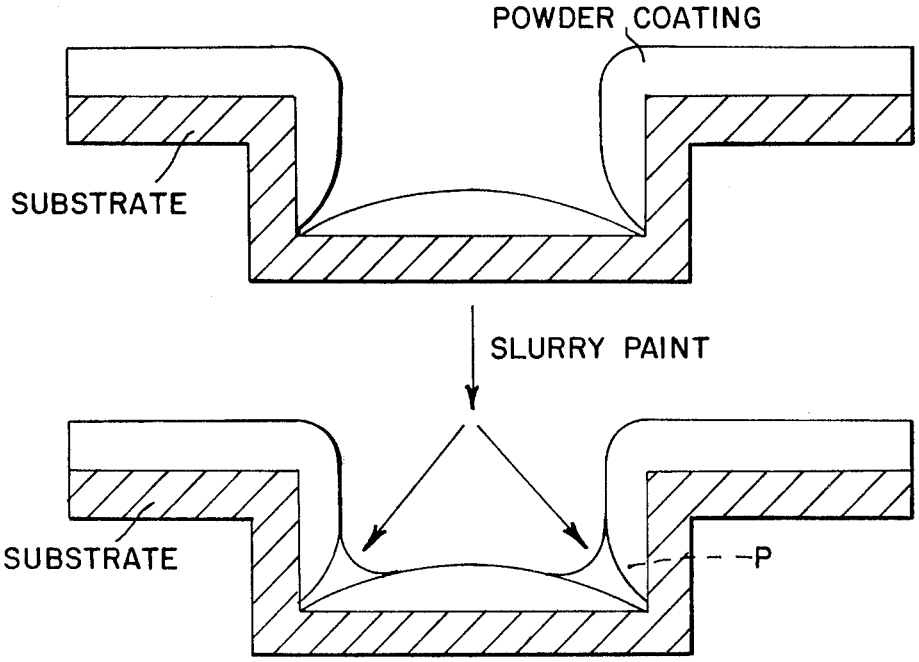
FIG. 4 illustrates the process of Example 6 in which the powder coating composition is applied to the entire surface of the substrate and then the slurry paint is applied to the areas where adhesion of the powder paint was insufficient. The figure shows that two coatings are applied also in the boundary areas, that is at points P.

What is claimed is:

1. A process for forming a multilayer coating including at least two layers on a metal substrate which consists of coating at least portions of said substrate with an undried lower coating layer of a powder coating composition which is at least one member selected from the group consisting of (A) a thermoplastic resin which is selected from the group consisting of vinyl chloride homopolymers and copolymers, polyethylene or polypropylene resins, nylon resins, linear saturated polyesters, cellulose derivatives and chlorinated polyethers, and (B) a thermosetting resin which is selected from the group consisting of an epoxy resin composition comprising (1) at least one epoxy resin selected from bisphenol type, novolak type and alicyclic type epoxy resins and (2) a curing agent selected from dicyandiamide or derivative thereof, acid anhydride, aromatic diamine, $BF_3$-amine complex, imidazole and dihydrazide, a polyester resin composition comprising (a) a polyester which is prepared by a condensation reaction of polyhydric alcohol and at least one of a saturated polybasic acid and an unsaturated polybasic acid, and (b) a curing agent selected from acid anhydrides, melamine resins, blocked isocyanate compounds, a compound having at least two glycidyl groups in the molecule, and ethylenic crosslinking monomers, acrylic resins and curing agents, and self-crosslinking acrylic resins, and before melting said powder coating applying thereon at least once a slurry paint comprising thermosetting synthetic resin particles to form a laminate coating, the slurry paint comprising 10 to 70% by weight of resin particles dispersed in a medium composed mainly of water, said resin particles having an average particle size of 4 to 30μ and a softening point of 5° to 120° C., and baking the resulting laminate coating at a temperature higher than the film-forming temperature of the coating layer having the highest film-forming temperature among respective coating layers.

2. A process according to claim 1 wherein the slurry paint comprises 20 to 60% by weight of resin particles dispersed in a medium composed mainly of water, said resin particles having a softening point of 50° to 120° C.

3. A process according to claim 1 wherein said slurry paint contains up to 30 parts by weight of at least one member selected from the group consisting of emulsion resins and water-soluble resins per 100 parts by weight of said resin particles.

4. A process according to claim 1 wherein said slurry paint comprises 0.05 to 30% by weight of a flaky aluminum pigment.

* * * * *